US005564165A

United States Patent [19]

Zander

[11] Patent Number: 5,564,165

[45] Date of Patent: Oct. 15, 1996

[54] METHOD AND APPARATUS FOR DETACHING FIBER TUFTS FROM SERIALLY POSITIONED FIBER BALES

[75] Inventor: Johann Zander, Mönchengladbach, Germany

[73] Assignee: Trützschler GmbH & Co. KG, Mönchengladbach, Germany

[21] Appl. No.: 434,922

[22] Filed: May 4, 1995

[30] Foreign Application Priority Data

May 5, 1994 [DE] Germany ..... 44 15 796.7

[51] Int. Cl.[6] ..... D01G 7/00; D01G 7/04; D01G 7/14

[52] U.S. Cl. ..... 19/80 R

[58] Field of Search ..... 19/80 R

[56] References Cited

U.S. PATENT DOCUMENTS

| | | | |
|---|---|---|---|
| 4,507,826 | 4/1985 | Keller et al. . | |
| 4,536,852 | 8/1985 | Hösel . | |
| 4,622,645 | 11/1986 | Hösel . | |
| 4,951,358 | 8/1990 | Binder et al. | 19/80 R |
| 5,105,507 | 4/1992 | Staheli et al. | 19/80 R |
| 5,179,763 | 1/1993 | Zander et al. | 19/80 R |
| 5,189,308 | 2/1993 | Kortlang et al. . | |
| 5,210,909 | 5/1993 | Toedtli | 19/80 R |
| 5,282,141 | 1/1994 | Faas | 19/80 R X |

FOREIGN PATENT DOCUMENTS

| | | | |
|---|---|---|---|
| 3135272 | 3/1983 | Germany | 19/80 R |
| 3245506 | 6/1983 | Germany . | |
| 3335793 | 4/1985 | Germany . | |
| 3335792 | 4/1985 | Germany | 19/80 R |
| 3932281 | 4/1991 | Germany . | |
| 4119888 | 12/1992 | Germany | 19/80 R |
| 1063879 | 12/1983 | U.S.S.R. . | |
| 1112070 | 9/1984 | U.S.S.R. | 19/80 R |
| 1416540 | 8/1988 | U.S.S.R. | 19/80 R |
| 2282152 | 3/1995 | United Kingdom . | |

OTHER PUBLICATIONS

Fritz Hösel, "Mikrocomputersteuerung für die Ballenabtragung", Internationales Textil-Bulletin Garnherstellung, Mar. 1986, pp. 9, 12, 13, 16, 19, 22.

*Primary Examiner*—John J. Calvert
*Attorney, Agent, or Firm*—Spencer & Frank

[57] ABSTRACT

A method of detaching fiber tufts from top surfaces of fiber bales which are set up in a fiber bale series along a travelling bale opener that operates with a vertically displaceable tuft-detaching device. The method includes the following steps: the bale height of all the bales of the series carried by the bale opener is determined by sensors; then data representing the bale height of the bale series, a vertical feed for the bales in the series having a minimum bale height and the determined bale height for all bales without feed change are inputted in a computer; then a proportionately higher feed for bales other than those having the minimum bale height is determined; and fiber tufts are detached from the top bale surfaces utilizing the predetermined feeds.

1 Claim, 5 Drawing Sheets

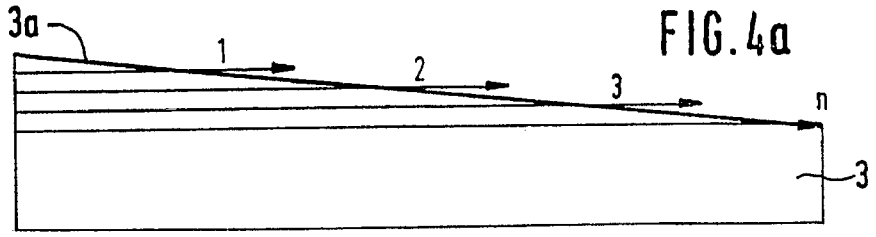
FIG. 4a
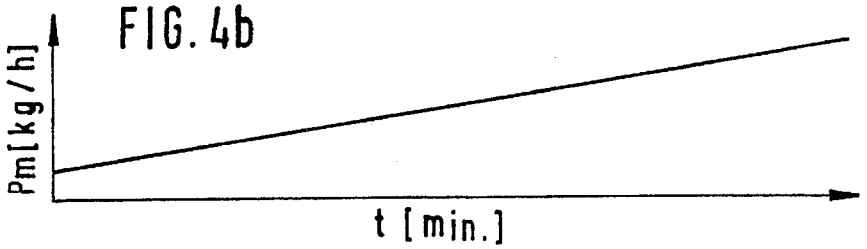
FIG. 4b
FIG. 5a
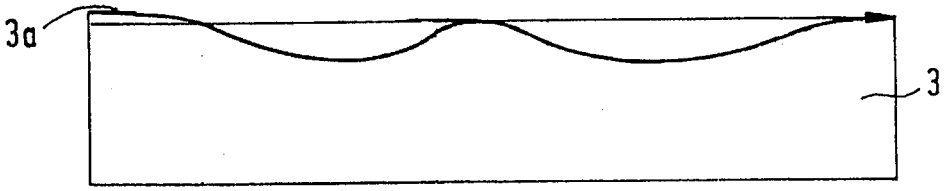
FIG. 5b
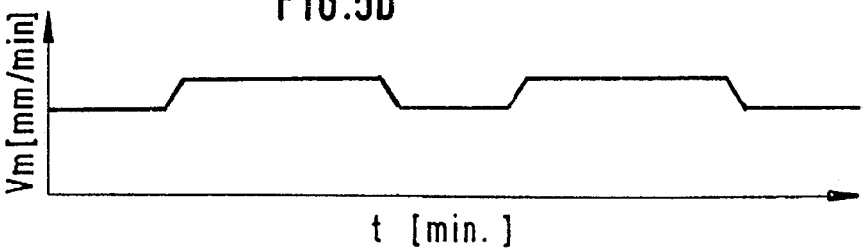
FIG. 5c
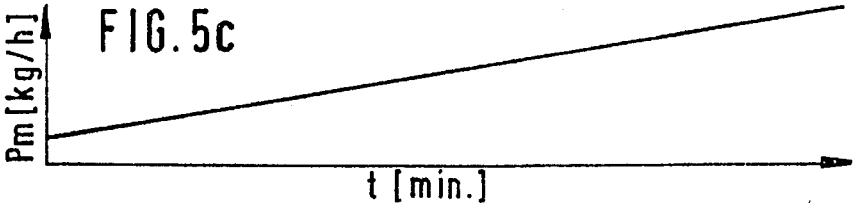

METHOD AND APPARATUS FOR DETACHING FIBER TUFTS FROM SERIALLY POSITIONED FIBER BALES

CROSS REFERENCE TO RELATED APPLICATION

This application claims the priority of German Application No. P 44 15 796.7 filed May 5, 1994, which is incorporated herein by reference.

BACKGROUND OF THE INVENTION

This invention relates to a method and an apparatus for detaching fiber tufts from fiber bales, arranged in at least one series, by means of a fiber bale opener which travels along the fiber bales and whose detaching device may vary its height. The bale opener has a tower carrying the height-adjustable detaching device in a cantilever fashion and further, sensors are provided which detect the momentary height level of the fiber bales and also, feed reduction signals are calculated to ensure a progressive height equalization in case the bales of the series have different heights.

The surface of the fiber bales is seldom even, that is, it does not have a constant height. Such surface height within one bale series may vary significantly, dependent upon the origin of the fiber and the extent of compression, particularly when the pressure on the bales is relieved by removing the bale ties. The upper surface of the bales is, dependent upon the previously effective compression, different, even within a single fiber bale and particularly in case when several fiber bale rows are set up side-by-side. The upper bale surface has to be equalized. In case of long bale sets (for example, up to a length of 40 m), it is economically not feasible to horizontally align the bale set. In case a 40 m long bale set varies only about 0.5% (which is visually difficult to ascertain, if at all possible), a height difference of 350 mm is present.

According to a known process, the pressing rolls carried by the detaching device and bearing down on the bale surface are sensor rolls which may move vertically to a predetermined extent. The sensor rolls generate, by virtue of their radial excursion, an "up" signal via a sensor device which monitors the radial displacement of the sensor rolls and, applies the signal to the detaching device and, at the same time, also generates a feed reduction signal. According to such a process, the height of the respective fiber bale is determined in a purely mechanical manner without calculation and thus without computer support only during the respective passes over the fiber bale and a different detaching depth is set. It is a disadvantage of such a prior art method that after surface equalization of the bale series a constantly maintained feed for all the bales cannot be securely obtained. In the middle bale zones too, the feed is changed during radial motions of the sensor roll which may lead to undesired wavy motions of the detaching device in the middle zones. It is a further drawback that by virtue of the mechanical sensing by means of the sensor rolls the upper face of the bales is compressed which may affect the measuring magnitude.

SUMMARY OF THE INVENTION

It is an object of the invention to provide an improved method and apparatus of the above-outlined type from which the discussed disadvantages are eliminated and which, in particular, ensures an equalization of different fiber bale heights in a reliable manner.

This object and others to become apparent as the specification progresses, are accomplished by the invention, according to which, briefly stated, the method of detaching fiber tufts from top surfaces of fiber bales set up in a fiber bale series along a travelling bale opener having a vertically displaceable tuft-detaching device, includes the following steps: determining the bale height of all the bales of the series by sensors carried by the bale opener; inputting, in a computer, data representing the bale height of the bale series, a vertical feed for the bales in the series having a minimum bale height and the determined bale height for all bales without feed change; determining a proportionately higher feed for bales other than those having the minimum bale height; and detaching fiber tufts from the top bale surfaces utilizing the predetermined feeds.

By virtue of the fact that after the first pass the sensed bale profile is stored and feed changes are calculated therefrom and thereafter, during the subsequent pass the surface of the bales is equalized, a work program may be obtained which external influences cannot change. It is a further advantage that in the mid zone—in which no feed changes occur—the precalculated feed is equal for each bale and is maintained securely constant.

In the apparatus according to the invention the cantilevered detaching device has at least two sensors with which the initial contour of the bale series is determined during a pass and further, a sensor is provided to determine the position of the bale opener along its travelling path. The sensors are connected to a computer which, from the inputted signals representing the vertical motions and longitudinal motions, generates feed reduction signals and controls the motor connected to the detaching device and the propelling motor of the bale opener as a function of the feed reduction signals.

According to advantageous features of the invention, the sensors are optical barriers; further, a path measuring device is provided for detecting the longitudinal motions of the detaching device and a height measuring device for detecting vertical motions of the detacher. Advantageously, the optical barriers are spaced vertically from one another.

BRIEF DESCRIPTION OF THE DRAWINGS

FIG. 4*a* is a diagram illustrating, in a side elevational view, a fiber bale series with an oblique upper surface.

FIG. 4*b* is a diagram illustrating the output rate as a function of time.

FIG. 5*a* is a diagram illustrating, in a side elevational view, a bale series with different surface heights.

FIG. 5*b* is a diagram illustrating the travelling speed of the bale opener as a function of time during a pass over a fiber bale series of FIG. 5*a*.

FIG. 5*c* is a diagram illustrating the output rate as a function of time.

DESCRIPTION OF THE PREFERRED EMBODIMENTS

Figure 1A:
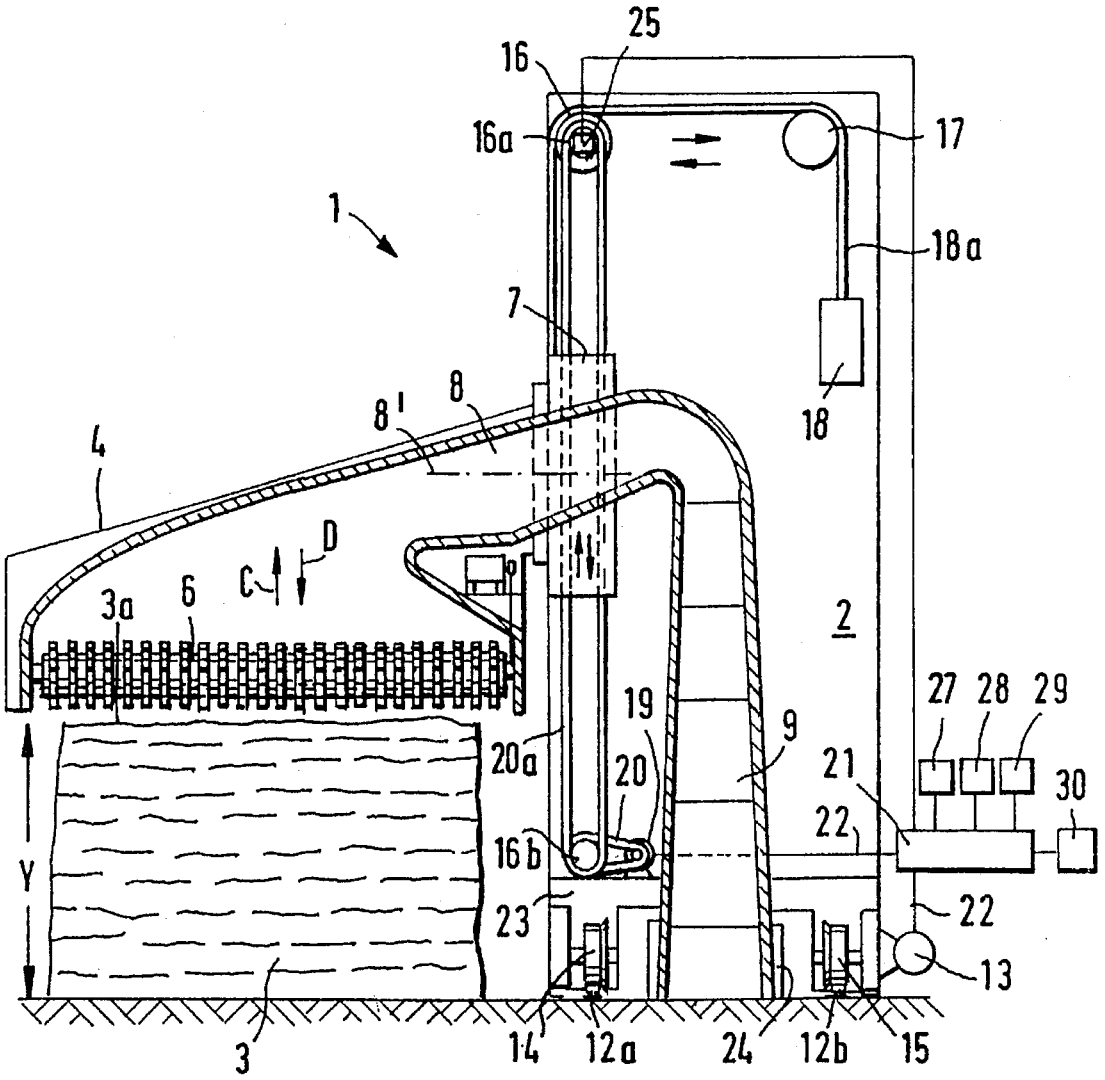
FIG. 1*a* is a schematic sectional front elevational view of a bale opener incorporating the invention.
Figure 1B:
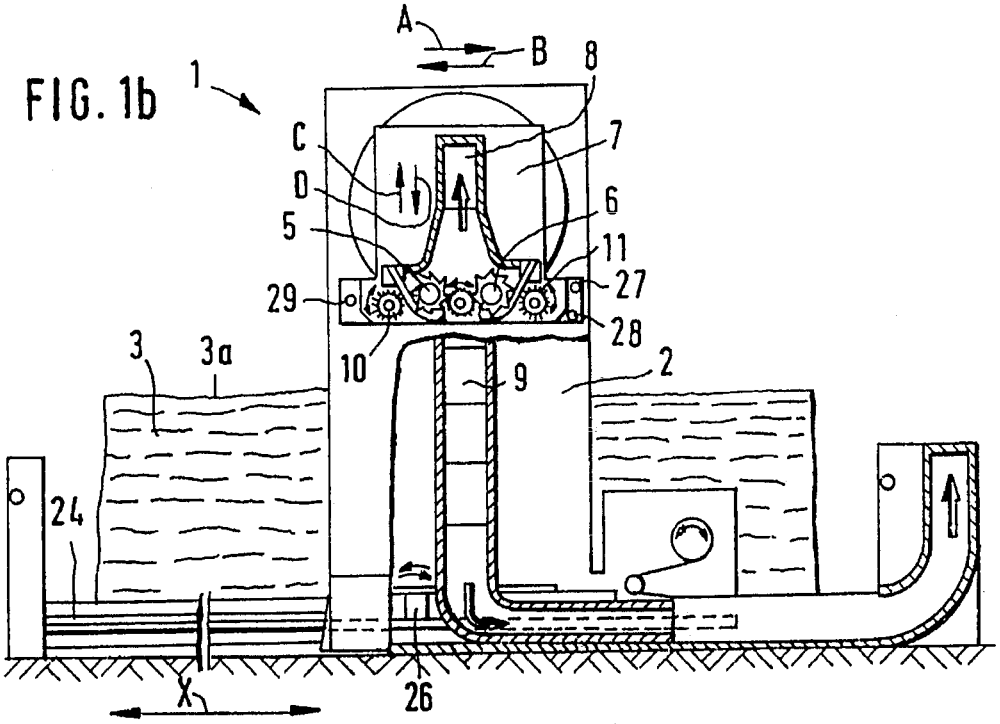
FIG. 1*b* is a schematic sectional side elevational view of the bale opener illustrated in FIG. 1*a*.

Turning to FIGS. 1*a* and 1*b*, the bale opener 1 illustrated therein may be, for example, a BLENDOMAT BDT model manufactured by Trützschler GmbH & Co. KG, Mönchengladbach, Germany. The bale opener has a tower 2 which may travel back and forth in the direction of arrows A and B along a bale series 3. The tower 2 carries a laterally projecting detaching device 4 which includes a single opening roll or—as illustrated in FIG. 1*b*—two oppositely rotating opening rolls 5 and 6. The detaching device 4 is supported in the tower 2 by means of a holding device 7. The fiber tufts removed by the opening rolls 5, 6 are carried away by suction through a duct 8 and a suction conduit 9. The suction conduit 9 opens into a suction channel 24 which is provided in the floor between rails 12*a*, 12*b*. Parallel to the opening rolls 5, 6 two slowly rotating supporting rolls (surface pressing rolls) 10, 11 are provided. The holding device 7 provides for a vertical displacement of the detacher 4 relative to the tower 2 as indicated by the arrows C, D. Thus, dependent upon the coordination of the travel of the bale opener 1 along the fiber bales with the vertical motion of the detacher 4 relative to the tower 2, the surface 3*a* of the fiber bale series 3 may be detached horizontally or obliquely.

The tower 2 is mounted on a carriage 23 provided with wheels 14, 15 that run on the rails 12*a*, 12*b* which straddle the suction channel 24 and along which the fiber bale series 3 extends. The tower 2 may be rotated about a vertical axis relative to the carriage 23. The bale opener 1 is propelled by a travel motor 13 which may be, for example, an rpm-variable, frequency-controlled asynchronous motor with which the travelling speed v may be set and controlled. The holding device 7 carrying the detacher 4 is suspended by a cable 18*a* and deflecting rolls 16 and 17 to a counterweight 18 and is connected to a lifting motor 19 which, similarly to the travel motor 13, may be an rpm-variable, frequency-controlled asynchronous motor. The lifting motor 19, with the intermediary of transmission elements 20, 20*a* (such as chains) and deflecting rolls 16*a*, 16*b* (for example, sprockets) lifts or lowers the detacher 4 relative to the tower 2.

The vertical displacement path (y) of the detacher 4 and the longitudinal displacement (x) of the bale opener 1 are controlled by a control device 21 via a control cable 22. The control device 21 may be a microprocessor, such as a BLENDCOMMANDER BC model, manufactured by Trützschler GmbH & Co. KG, Mönchengladbach, Germany. For the determination of the detacher position in the height direction (y-axis) there is provided an angular displacement sensor 25 in association with the deflecting roller 16. For the determination of the position of the bale opener along the x-axis a displacement sensor 26 is provided.

In the description which follows, the method according to the invention will be described in conjunction with several examples.

Figure 6:
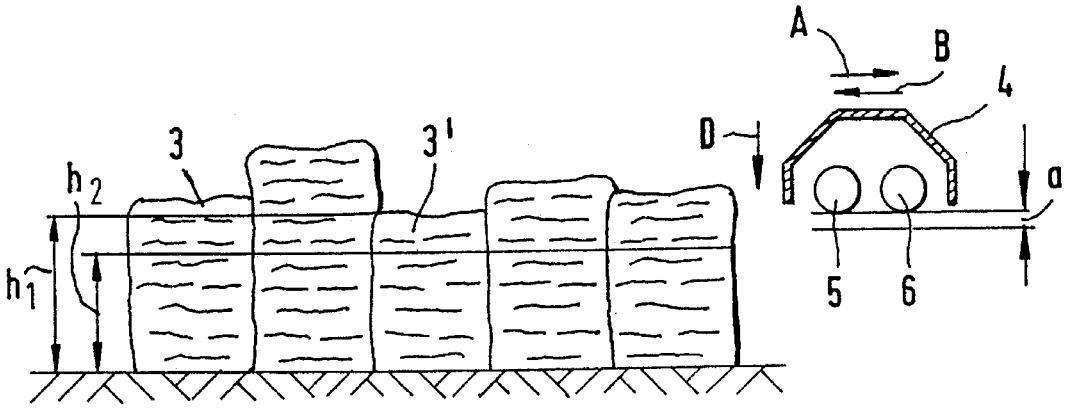
FIG. 6 is a side elevational view of a bale series formed of bales having different surface heights.

Referring in particular to FIGS. 1*a* and 6, by means of a pressure sensor 30 the magnitude of the vertical feed for the bales 3' having the smallest height $h_1$ in the bale series and a common bale height $h_2$ for all bales where no feed change is needed are first stored in the computer 21. For each bale series that is set up, a feed a between 0.1 and 19.9 mm is applied. The feed a is the thickness of the fiber material layer which, during each pass of the bale opener, is detached from the individual bales of the series by the opening rolls 5, 6. The required feed a of the detacher 4 is determined as a function of the required production rate. Then the computer 21 automatically senses the height h (initial bale height) of the bale series 3. The determined values are stored.

Figure 2:
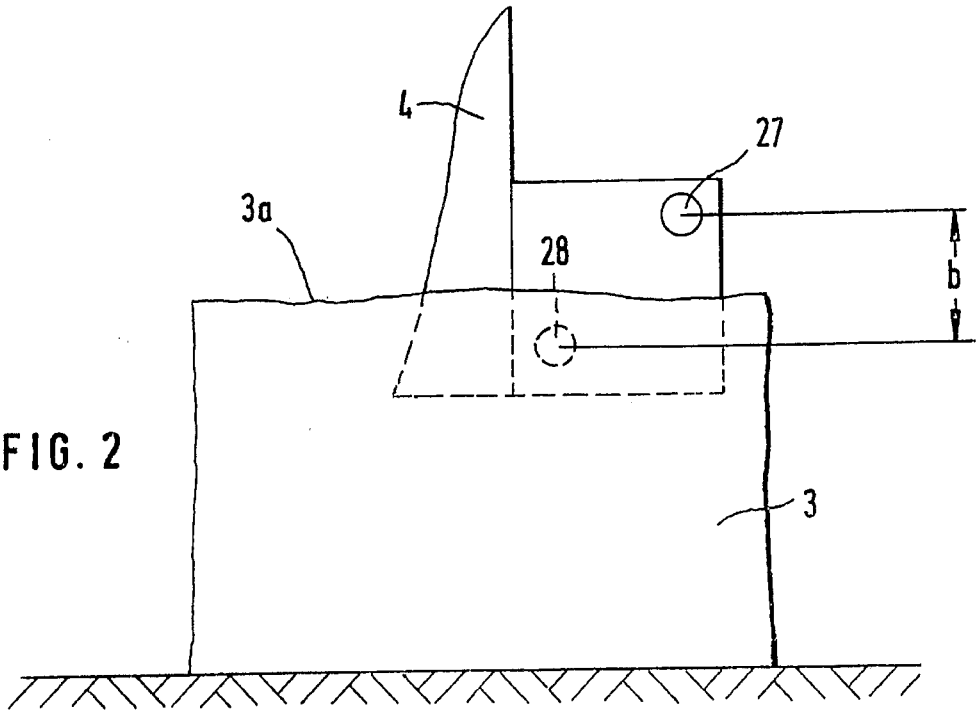
FIG. 2 is a front elevational detail of the construction shown in FIG. 1*a*.
Figure 3A:
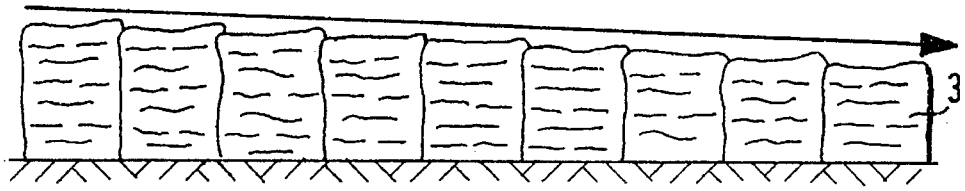
FIG. 3*a* is a side elevational view of a bale series having an obliquely extending upper surface and associated with a decreasing detaching height.
Figure 3B:
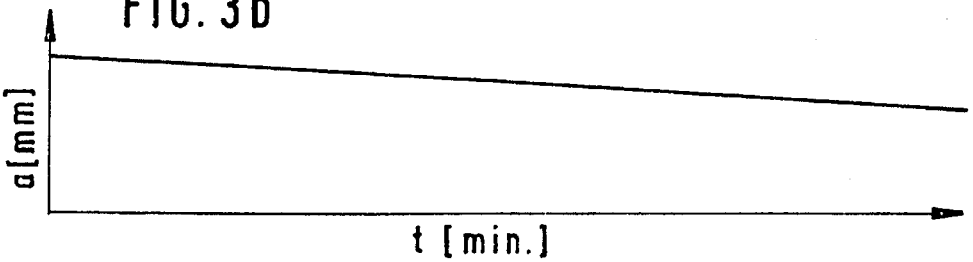
FIG. 3*b* is a diagram illustrating the vertical feed as a function of time.
Figure 3C:
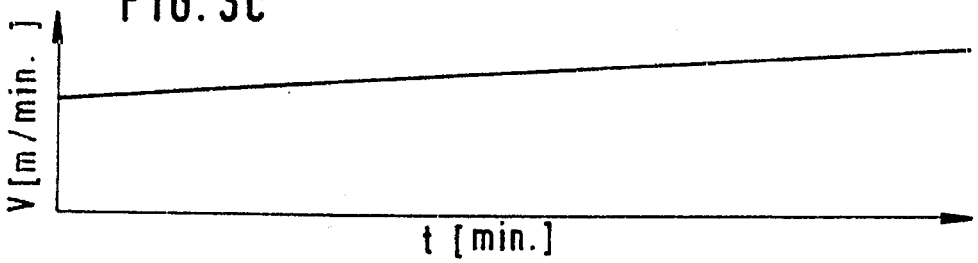
FIG. 3*c* is a diagram illustrating the travelling speed of the bale opener as a function of time.
Figure 3D:
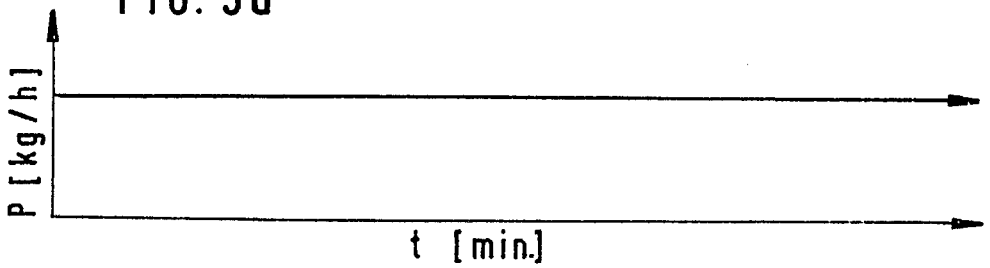
FIG. 3*d* is a diagram illustrating the production rate as a function of time.

Also referring to FIGS. 1*b* and 2, for determining the bale group height h, the detaching device 4 carries three optical barriers, such as a frontal, upper optical barrier 27, a frontal, lower optical barrier 28 and a rear optical barrier 29. The determination of the bale group height h is effected with the aid of all three optical barriers during the first pass (programming pass). During this pass the detacher 4 travels approximately along the contours of the bale surfaces 3*a*. The determination of the height is effected alternatingly between the two front light barriers 27 and 28. The determination of a gap between bale groups is effected by the rear optical barrier 29. In short time intervals the momentary detacher height—which in essence corresponds to the bale height h—is stored in the control device 21. The detacher 4 travels above the bale groups 3 and senses their beginning, their end and their height h while production is already in progress.

After the one-time height determination h the value is internally stored in the computer 21. Thereafter, the proportionally greater feed a is calculated for the other bales which do not have the minimum height. Eventually, the actual height $h_1$ to $h_n$ is corrected in each instance by the amount by which the detacher 4 travels deeper (feed a) during a pass, and it is very simple to vary, in dependence therefrom, the travelling speed v as well.

EXAMPLE 1

Reference is made to FIGS. 3*a* to 3*d*.

During the programming pass the contour 3*a* of the bale series 3 is stored. After the programming pass, by means of continuous adaptation of the detaching device 4 to the momentary bale height, a pass is performed over the bale series 3. By means of a determined number of passes with increasing feed the detaching device 4 is so controlled that after the process the height of the bale series is equalized.

In order to further improve this process, the travelling speed v is controlled as a function of the feed a. At locations where the detaching operation is performed with a greater feed a the travelling speed v is normal. In contrast, where the detaching operation is performed with a smaller feed a, the travelling speed v is correspondingly greater.

ADVANTAGES

The complexity in equalizing the height of the bale series is reduced. The production loss during the equalizing phase is also significantly diminished. Also, the mixture break (unintentional variations of mixture, particularly as viewed from bale to bale) is reduced.

EXAMPLE 2

Reference is made to FIGS. 4*a* and 4*b*.

If, after the programming pass over a bale series 3 it is determined that the bale series 3 has an obliquely extending surface or has depressions at one or more locations, the procedure is as follows:

Oblique bale series

The detacher 4 travels with a constant height only over a part of the bale series where production is calculated. With each further feed increase the travelling path is augmented until the entire bale series is worked on.

EXAMPLE 3

Reference is made to FIGS. 5*a*, 5*b* and 5*c*.

Depressions in the bale series

The detaching device 4 travels at a constant height only over those locations of the bale series 3 where a production is calculated. In the depressions where the detaching device does not produce, the travelling speed is increased.

ADVANTAGES

The production loss is reduced in the equalizing phase.

The actual drive concept need not be changed.

DISADVANTAGE

The mixture break cannot be improved.

FIG. 6 shows the bale series having different initial heights h of the individual bales 3. The bale 3' has the smallest height $h_1$. The reference character $h_2$ designates that height from which all bales 3 are being worked on without feed reduction (that is, with a constant feed a).

In FIGS. 3–5, the ordinate indicates the working period t in minutes. In the alternative, one may use the length l which is the length of the bale series 3.

The invention encompasses the detaching of a bale series either with decreasing or with increasing surface in case of a long bale series as well as with different initial heights of the individual bales of the bale series 3.

It will be understood that the above description of the present invention is susceptible to various modifications, changes and adaptations, and the same are intended to be comprehended within the meaning and range of equivalents of the appended claims.

What is claimed is:

1. A method of detaching fiber tufts from top surfaces of fiber bales set up in a fiber bale series along a travelling bale opener having a vertically displaceable tuft-detaching device, comprising the following steps:

(a) determining bale heights of all the bales of the series by sensors carried by the bale opener;

(b) inputting, in a computer, data representing the bale height of the bale series, a vertical feed of the detaching device for the bales in the series having a minimum bale height and a common bale height for all bales where no feed change is required;

(c) determining a proportionately higher feed for bales other than those having the minimum bale height; and (d) detaching fiber tufts from the top bale surfaces utilizing the determined vertical feeds.

* * * * *